US008332968B1

(12) United States Patent
Williams

(10) Patent No.: US 8,332,968 B1
(45) Date of Patent: Dec. 18, 2012

(54) PANTS WITH EXPANDABLE POUCH

(76) Inventor: Cary J. Williams, Tomball, TX (US)

( * ) Notice: Subject to any disclaimer, the term of this patent is extended or adjusted under 35 U.S.C. 154(b) by 215 days.

(21) Appl. No.: 12/592,002

(22) Filed: Nov. 18, 2009

Related U.S. Application Data

(63) Continuation-in-part of application No. 11/900,161, filed on Sep. 10, 2007, now abandoned.

(60) Provisional application No. 60/847,257, filed on Sep. 26, 2006.

(51) Int. Cl.
*A41B 9/02* (2006.01)

(52) U.S. Cl. ..... 2/405; 2/238; 2/400; 2/403; 2/404

(58) Field of Classification Search ..... 2/400–405, 2/228, 238; 450/104; 602/67–68
See application file for complete search history.

(56) References Cited

U.S. PATENT DOCUMENTS

| | | | | |
|---|---|---|---|---|
| 2,033,266 | A * | 3/1936 | Vinyard | 602/67 |
| 3,039,111 | A * | 6/1962 | Joseph | 2/80 |
| 3,083,710 | A * | 4/1963 | Rauser | 602/67 |
| 5,598,587 | A * | 2/1997 | Wada | 2/403 |
| 6,023,789 | A * | 2/2000 | Wilson et al. | 2/228 |
| 2004/0107481 | A1 * | 6/2004 | Mortell et al. | 2/400 |
| 2006/0191059 | A1 * | 8/2006 | Smith | 2/400 |

* cited by examiner

*Primary Examiner* — Khoa Huynh
*Assistant Examiner* — Khaled Annis

(57) ABSTRACT

An elongated crotch section is combined with seam construction to provide comfort to the wearer. Two front pieces and two back pieces are formed into or stitched to a waist band. A two piece center section forming a crotch of the boxer is without multiple seams. Seams are only on the sides and a single horizontal seam connects the two pieces of the crotch portion. The two piece crotch component forms an elongated pouch to hold the male genitalia. There is no junction of multiple seams at the groin or inseam.

2 Claims, 2 Drawing Sheets

FIG 1
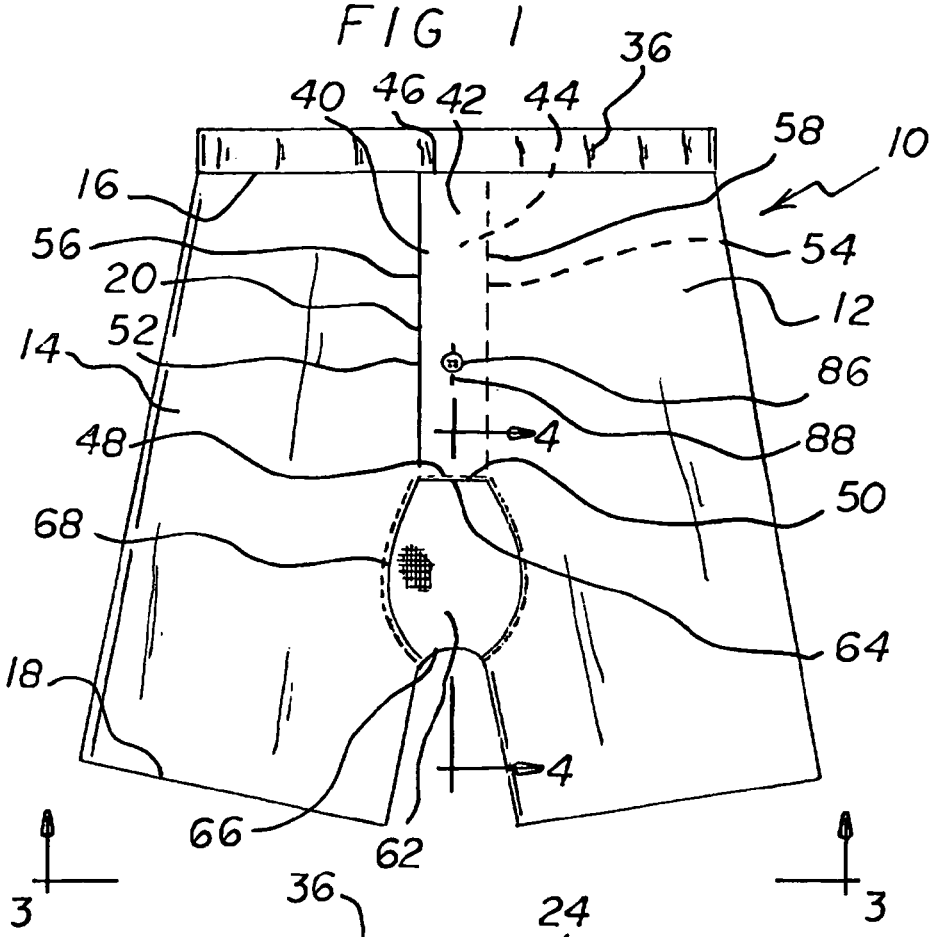
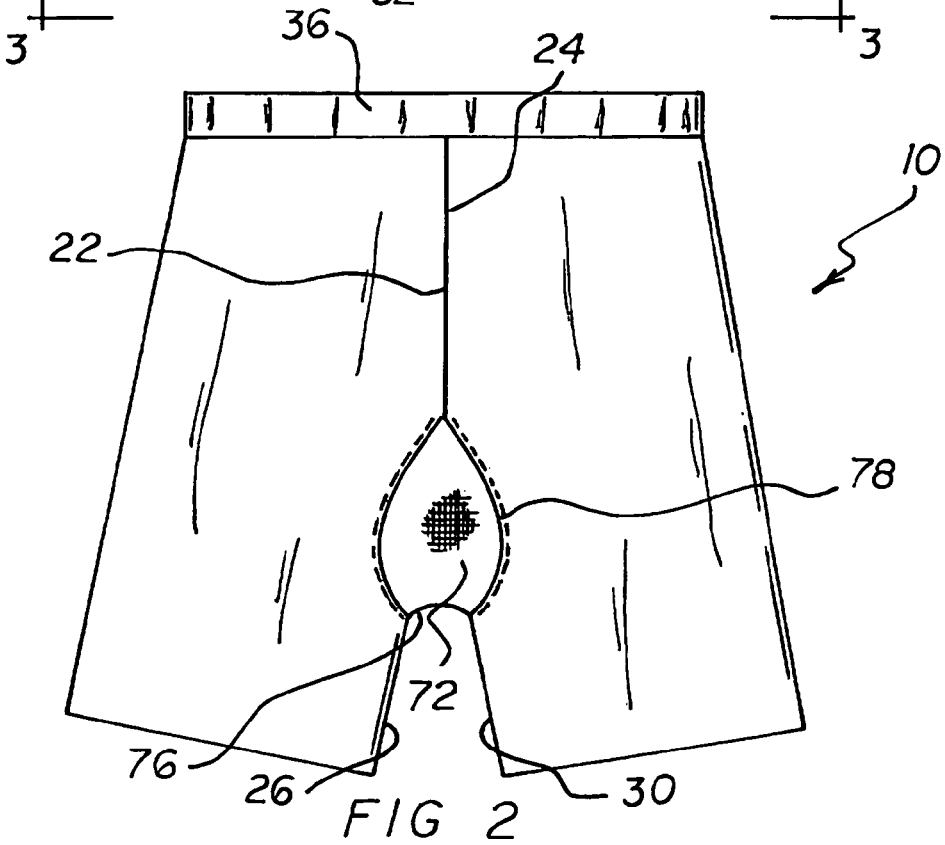
FIG 2

FIG 3
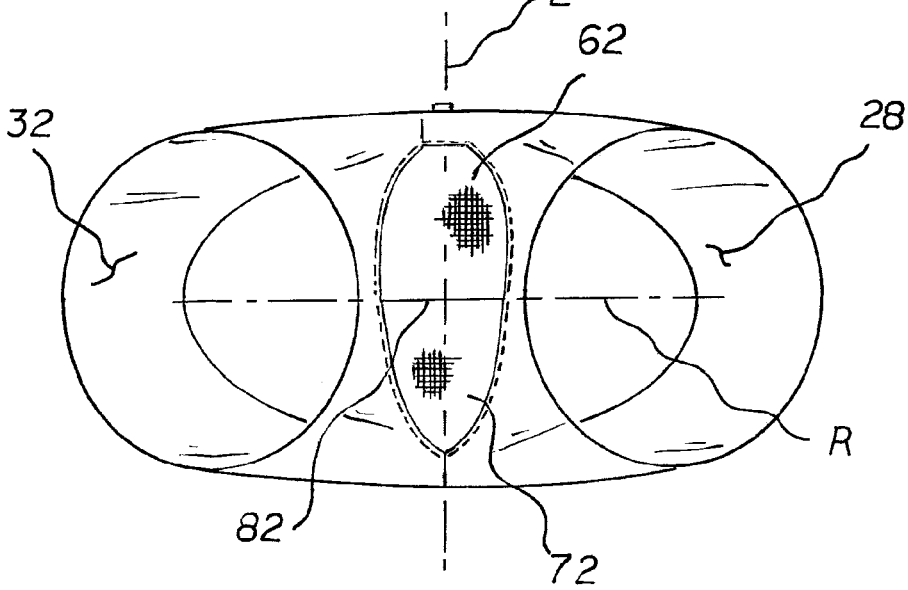
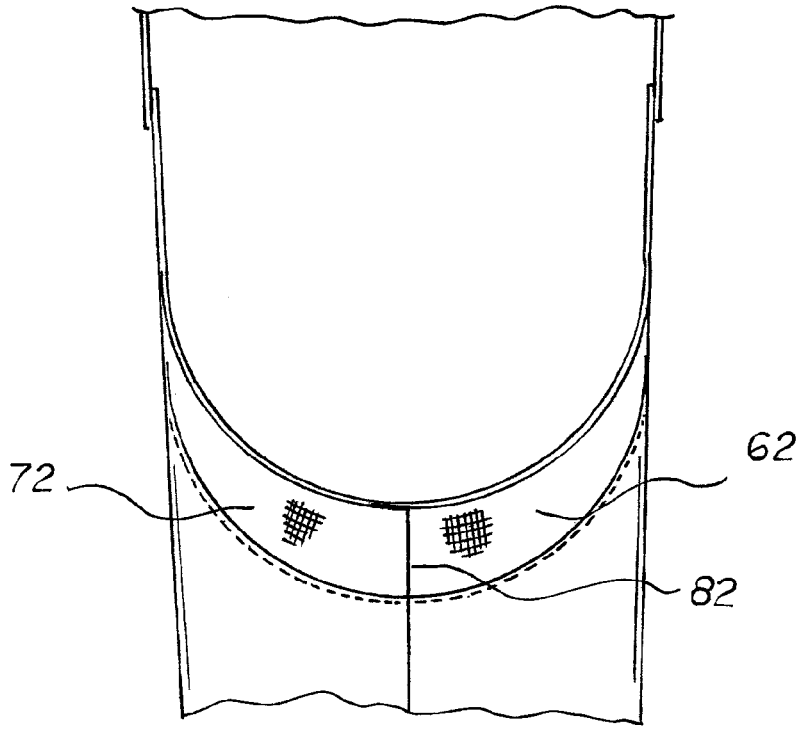
FIG 4

PANTS WITH EXPANDABLE POUCH

RELATED APPLICATION

This application is a continuation-in-part application claiming the benefit of application Ser. No. 11/900,161 filed Sep. 10, 2007 now abandoned which, in turn, claims the benefit and priority of Provisional Application No. 60/847,257 filed Sep. 26, 2006, the subject matter of which applications is incorporated by reference herein.

BACKGROUND OF THE INVENTION

1. Field of the Invention

The garment subject of this disclosure pertains to a novel construction of men's boxer shorts, particularly for enhanced comfort in the crotch or groin area. The construction of the garment may also be more contemporary clothing such as the "Hip-Hop" length. The construction allows a longer inseam for more room and manageability, particularly designed for enhanced comfort in the crotch or groin area.

2. Related Technology

The issue of a wearer's comfort when wearing jockey shorts has been the subject of various disclosures such as that disclosed in U.S. Pat. No. 5,598,587 relating to Men's Underwear Briefs, issued Feb. 4, 1997 to inventor Mikuni Wada.

SUMMARY OF INVENTION

The present invention is a garment which includes a front and back garment portion and sewing of the front portion to the back portion at the garment sides and forming legs with sewn inseams. A two piece crotch portion comprises a front and back portion. The front crotch portion having a right edge and a left edge and the back crotch portion having a right edge and a left edge are sewn together in a lateral direction. The right side of the front crotch portion is sewn to a left edge of the front garment portion and the left edge of the front crotch portion is sewn to the right edge of the front garment portion. Further, the right side of the back crotch portion is sewn to the left edge of the back garment portion and the left side of the back crotch portion is sewn to the right edge of the back garment portion with the completely sewn crotch portion forming an elongated pouch between the legs of the garment. The construction may contain a longer inseam and a more comfortable design, which includes the innovative two piece center sections, with optional stretch spandex such as Lycra, that provide more room for comfort and manageability.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of boxer shorts constructed in accordance with the principles of the present invention.

FIG. 2 is a rear elevational view of the boxer shorts shown in FIG. 1.

FIG. 3 is a bottom view of the boxer shorts shown in FIGS. 1 and 2.

FIG. 4 is a cross sectional view taken along line 4-4 of FIG. 1.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved boxer shorts embodying the principles and concepts of the present invention and generally designated by the reference numeral 10 will be described.

The present invention is boxer shorts 10 adapted to provide extended comfort particularly in a groin area of a wearer. First provided is a left panel 12. Next provided is a similarly configured right panel 14. Each panel has a horizontal upper edge 16 and a horizontal lower edge 18. Each panel also has a vertical front edge 20 and a vertical rear edge 22. An upper rear seam 24 is vertically oriented and couples the rear edge of the left panel and the rear edge of the right panel adjacent to the upper edges. A left lower inseam 26 is vertically oriented and couples the vertical front edge and the vertical rear edge of the left panel. In this manner a tubular left section 28 is formed for receiving a wearer's left leg. A right lower inseam 30 is vertically oriented and couples the vertical front edge and the vertical rear edge of the right panel. In this manner, a tubular right leg section 32 is formed for receiving the wearer's right leg.

Next provided is an elastic waistband 36. The waistband is horizontally oriented and is coupled to the upper edge of the left panel and to the upper edge of the right panel. The upper edge of the left panel and the upper edge of the right panel are shirred when coupled to the waistband. In this manner, the waistband is adapted to receive the wearer's waist.

Next, a fly 40 is formed from two overlapping rectangular sheets 42, 44. Each sheet has a horizontal upper edge 46 coupled to the waistband and each sheet has a parallel lower edge 48, 50. Each sheet has a vertical lateral free edge 52, 54 and a parallel attached edge 56, 58 coupled to one of the front edges of one of the panels. The leg panels and the sheets of the fly are woven of essentially inextensible yarn.

A front crotch piece 62 is next provided. The front crotch piece has a horizontal upper edge 64 coupled to the lower edges of the sheets of the fly. The front crotch piece has a lower edge 66. The front crotch piece has spaced lateral edges 68 coupled to the front edges of the leg panels between the fly and the lower inseams. The fly has a height greater than the front crotch piece. The fly has a height greater than the lower inseams.

Next, a rear crotch piece 72 is provided. The rear crotch piece has an upper point 74 coupled to the upper rear seam. The rear crotch piece has a lower edge 76. The rear crotch piece has spaced lateral edges 78 coupled to the rear edges of the panels between the rear seam and the inseams. The crotch pieces are knit of an essentially stretchable yarn. The upper rear seam has a height greater than the rear crotch piece. The upper rear seam has a height greater than the lower inseams.

Finally, a lower stitching 82 is provided. The lower stitching joins the lower edge of the front crotch piece and the lower edge of the rear crotch piece. The lower stitching is positioned to extend radially in a direction parallel to a radial axis (R shown in FIG. 3) that is perpendicular to a longitudinal axis of said fly (L shown in FIG. 3).

In an alternate embodiment of the invention, a button 86 and a button hole 88 are provided in the sheets of the fly. In this manner, the fly between the sheets may be for selectively opened and closed.

By way of further explanation, the garment of the present invention is referred to as boxer shorts, hereinafter "boxer", but other clothing items may incorporate the invention, e.g., pants, athletic shorts, etc.

The boxers may comprise six pieces. There are two front pieces and two back pieces. The top portion of these pieces can form a waist band. Alternatively the waist band can be a separate sewn piece. The boxer also includes a center crotch section, which may be of two pieces.

As indicated, the boxers also are constructed with a two piece center section in the design of the crotch of the boxer. The two piece crotch component is designed to be substantially without multiple seams that meet in the inseam of the crotch section located in the groin area. The boxer is designed to only have seams that are placed on the sides of the crotch portion and a single horizontal seam that connect the two pieces of the crotch portion. This enhances the wearer's comfort. There is no single seam running from the bottom end of the fly of the boxer straight to the groin or inseam. The seam is divided by the center section or crotch section. The two piece crotch component also forms an elongated pouch to hold the male genitalia. Again, unlike many other styles of boxers, there is no junction or combining of multiple seams at the groin or inseam of the boxer.

In another embodiment, the boxers comprise a front portion and a back portion, along with the two piece center crotch. This results in a garment comprised of four pieces. The front and back portions may be joined at side seams as is customary with boxers or pants. The back and front portion form legs for the boxers. The inside seam may be termed the inseam. The inseam is defined as the inner seam of a pair of pants or boxers from the crotch section. The inseam causes congestion and discomfort in the groin area. This is particularly acute where multiple seams intersect, e.g., the second inseam. The front and back portion also form the circumference for the waist. As discussed, there is a two piece center section, sometimes termed the "crotch section" or "crotch components", of the boxer covering the crotch area of the wearer. This also has a front piece and a back piece. The front and back pieces are dimensioned to widely fit over the crotch area of the wearer. The front and back pieces also form an elongated space within the boxer between the wearer's legs. The seam holding the two sections of the crotch component may be lateral, i.e., running from on leg inseam to the other. This seam is shown in the drawings. Again, there is no junction of multiple seams in the crotch area.

In another embodiment, the garment comprises two portions. Each portion has a front and back component. Each portion forms a half of the garment, i.e., a right half and a left half. The two portions are sewn together in the middle. There is also the crotch portions which are sewn into position between the two halves.

In yet another embodiment, the garment is made of a single piece of fabric. This may be a tube shape with the bottom section split and sewn to form two legs. Inserted into the garment is the two piece or single piece crotch component.

The crotch components can be made with stretch spandex such as sold under the trademark Lycra® or similar stretchable material. (Lycra is a registered trademark of Invista North America S.A.R.L.) This along with the insert of a two piece center section can substantially enhance the wearer's comfort.

The figures illustrate a garment comprised of six pieces. The front portions of the boxers consist of two pieces. The back portion of the boxer comprises two pieces. The right side front and back portions are sewn at the sides or fabric edges. The other side of the two piece front and back portions are also sewn. The front and back portions are also sewn at the inseam. The two back portions are joined at a seam. The front crotch portion and back portion are sewn to the front and back edges of the boxers.

In another embodiment, the fly of the boxer is uniquely constructed with the flat horizontal seam at the bottom connecting to the top of the center crotch section. The fly is formed by folding an edge of front left portion and a sight fold on the right, both sewn with a horizontal seam at the ends, and with a diagonal seam three quarters at the top near the waist. The diagonal seam can function for closure. The garment may also be constructed with a button or a hook and loop material.

Illustrated in the drawings is the placement of seams distant from the center of the wearer's crotch. This allows for increased room in the crotch area and for greater comfort.

Also illustrated in the drawings are the two front panels joined at the seam forming part of the flap or "fly" of the boxers. This meeting of fabric panels can include buttons or zippers to create a front opening for the wearer's convenience. It may also include Velcro® hook and loop type fasteners. Velcro is the registered trademark of Velcro Industries B.V. LTD LIAB CO. The front panels are also sewn to the front crotch piece at seams joining fabric edges of the center crotch section and the front portions of the boxer. The leg portion of the front and back panels are joined at inseams.

The seam connecting the front and back crotch pieces is also shown.

The seams connecting the front panels to the back panels are shown and the seam connecting the two back panels are also illustrated. Seam are shown in phantom. The two back panels are also sewn to the back portion of the crotch piece.

In the prior art, the front and back vertical seams join at the crotch. The inseams also join at the crotch. The four seams and accompanying fabric meet in the crotch section and cause congestion and discomfort to the user. This accumulation of fabric and seams can create a lump that can cause the wearer additional discomfort. One attribute of the present invention is to eliminate this accumulation of fabric in the crotch section.

It will be appreciated that the invention can also be adapted to trousers or pants.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Boxer shorts adapted to provide extended comfort particularly in a groin area of a wearer, the boxer shorts comprising, in combination:

a left panel and a similarly configured right panel, each panel having a horizontal upper edge and a horizontal lower edge and a vertical front edge and a vertical rear edge, an upper rear seam vertically oriented and coupling the rear edge of the left panel and the rear edge of the right panel adjacent to the upper edges, a left lower inseam vertically oriented and coupling the vertical front edge and the vertical rear edge of the left panel to form a tubular left section for receiving a wearer's left leg, a right lower inseam vertically oriented and coupling the vertical front edge and the vertical rear edge of the right panel to form a tubular right leg section for receiving the wearer's right leg;

an elastic waistband horizontally oriented and coupled to the upper edge of the left panel and to the upper edge of the right panel, the upper edge of the left panel and the upper edge of the right panel being shirred when coupled to the waistband for receiving the wearer's waist;

a fly formed from two overlapping rectangular sheets, each sheet having a horizontal upper edge coupled to the waistband and a parallel lower edge, each sheet having a vertical lateral free edge and a parallel attached edge coupled to one of the front edges of one of the panels, the leg panels and the sheets of the fly being woven of essentially inextensible yarn;

a front crotch piece having a horizontal upper edge coupled to the lower edges of the sheets of the fly and having a lower edge, the front crotch piece having spaced lateral edges coupled to the front edges of the panels between the fly and the lower inseams, the spaced lateral edges of the front crotch piece each formed in a continuous curved configuration substantially half oval shape; wherein the front crotch piece is separated from and located below said fly;

a rear crotch piece having an upper point coupled to the upper rear seam, the rear crotch seam having a lower edge, the rear crotch piece having spaced lateral edges coupled to the rear edges of the panels between the upper rear seam and the lower inseams, the spaced lateral edges of the rear crotch piece each, formed in a continuous curved configuration substantially half oval shape, the front and rear crotch pieces being knit to be essentially stretchable; and a lower stitching joining the lower edge of the front crotch piece and the lower edge of the rear crotch piece to thereby join the opposed lateral edges of the front and rear crotch pieces; wherein the lower stitching is positioned to extend radially in a direction parallel to a radial axis that is perpendicular to a longitudinal axis of said fly;

the front crotch piece thus forming a continuous, uninterrupted one-piece body-supporting member of knitted material bounded by a periphery defined by a left edge stitched to the left panel and by a right edge stitched to the right panel and by an upper edge stitched to and contiguous with the two overlapping rectangular sheets of the fly and by a lower edge stitched to the rear crotch piece using said lower stitching, the rear crotch piece thus forming a continuous, uninterrupted one-piece body supporting member of knitted material bounded by a periphery defined by a left edge stitched to the left panel and by a right edge stitched to the right panel and by an upper edge stitched to the left and right panels and by a lower edge stitched to the front crotch piece using said lower stitching.

2. Pants adapted to provide extended comfort particularly in a groin area of a wearer, the pants comprising, in combination:

a left panel and a similarly configured right panel, each panel having a horizontal upper edge and a horizontal lower edge and a vertical front edge and a vertical rear edge, an upper rear seam vertically oriented and coupling the rear edge of the left panel and the rear edge of the right panel adjacent to the upper edges, a left lower inseam vertically oriented and coupling the vertical front edge and the vertical rear edge of the left panel to form a tubular left section for receiving a wearer's left leg, a right lower inseam vertically oriented and coupling the vertical front edge and the vertical rear edge of the right panel to form a tubular right leg section for receiving the wearer's right leg;

a fly formed from two overlapping rectangular sheets, each sheet having a horizontal upper edge coupled to a waistband and a parallel lower edge, each sheet having a vertical lateral free edge and a parallel attached edge coupled to one of the front edges of one of the panels, the leg panels and the sheets of the fly being woven of essentially inextensible yarn;

a front crotch piece having a horizontal upper edge coupled to the lower edges of the sheets of the fly and having a lower edge, the front crotch piece having spaced lateral edges coupled to the front edges of the panels between the fly and the lower inseams, the spaced lateral edges of the front crotch piece each formed in a continuous curved configuration substantially half oval shape; wherein the front crotch piece is separated from and located below said fly;

a rear crotch piece having an upper point coupled to the upper rear seam, the rear crotch seam having a lower edge, the rear crotch piece having spaced lateral edges coupled to the rear edges of the panels between the upper rear seam and the lower inseams, the spaced lateral edges of the rear crotch piece each formed in a continuous curved configuration substantially half oval shape, the front and rear crotch pieces being knit to be essentially stretchable; and a lower stitching joining the lower edge of the front crotch piece and the lower edge of the rear crotch piece to thereby join the opposed lateral edges of the front and rear crotch pieces; wherein the lower stitching is positioned to extend radially in a direction parallel to a radial axis that is perpendicular to a longitudinal axis of said fly;

the front crotch piece thus forming a continuous, uninterrupted one-piece body-supporting member of knitted material bounded by a periphery defined by a left edge stitched to the left panel and by a right edge stitched to the right panel and by an upper edge stitched to and contiguous with the two overlapping rectangular sheets of the fly and by a lower edge stitched to the rear crotch piece using said lower stitching, the rear crotch piece thus forming a continuous, uninterrupted one-piece body supporting member of knitted material bounded by a periphery defined by a left edge stitched to the left panel and by a right edge stitched to the right panel and by an upper point stitched to the left and right panels and by a lower edge stitched to the front crotch piece using said lower stitching.

* * * * *